US006795564B2

(12) United States Patent
Zhang

(10) Patent No.: US 6,795,564 B2
(45) Date of Patent: Sep. 21, 2004

(54) ENERGY CONVERTER WITH TWO COILS AND TWO MAGNETIC GAPS

(75) Inventor: Fan Zhang, Sichuan Province (CN)

(73) Assignees: Fan Zhang, Sichuan (CN); Zhixiong Liu, Guangdong (CN)

( * ) Notice: Subject to any disclaimer, the term of this patent is extended or adjusted under 35 U.S.C. 154(b) by 0 days.

(21) Appl. No.: 10/369,141

(22) Filed: Feb. 18, 2003

(65) Prior Publication Data

US 2004/0066263 A1 Apr. 8, 2004

Related U.S. Application Data

(63) Continuation of application No. PCT/CN00/00241, filed on Aug. 18, 2000.

(51) Int. Cl.[7] ..... H04R 1/00
(52) U.S. Cl. ..... 381/420; 381/421; 381/395
(58) Field of Search ..... 381/420, 421, 381/396, 412, 395, 332

(56) References Cited

U.S. PATENT DOCUMENTS

| | | | | |
|---|---|---|---|---|
| 5,848,165 A | * | 12/1998 | Pritchard | 381/61 |
| 6,212,284 B1 | * | 4/2001 | Puls | 381/345 |
| 6,330,340 B1 | * | 12/2001 | Proni | 381/397 |
| 6,418,231 B1 | * | 7/2002 | Carver | 381/395 |

FOREIGN PATENT DOCUMENTS

| | | | |
|---|---|---|---|
| CN | 2230070 Y | 6/1996 | H04R/9/06 |
| CN | 1207011 A | 2/1999 | H04R/9/06 |
| JP | 6-233380 | 8/1994 | H04R/9/04 |
| JP | 06-269076 | 9/1994 | H04R/1/24 |
| JP | 08-289385 | 11/1996 | H04R/1/24 |

OTHER PUBLICATIONS

Kim, US2002/0027491A1, Jul. 2002.*
Kobayashi, US2002/0064295A1, May 2002.*
Kobayashi, US2002/0076078A1, Jun. 2002.*

* cited by examiner

*Primary Examiner*—Anh Mai
(74) *Attorney, Agent, or Firm*—Fish & Richardson P.C.

(57) ABSTRACT

A converter with two coils and two magnetic gaps of which the upper and lower yokes of are two innerwardly concave plates or round plates. 3 set or more than 3 sets of axially magnetized permanent magnets are provided. Said permanent magnets are directly engaged with pole faces of said plates. Two magnetic gaps are formed between the vertical peripheric faces of said plates and the outer peripheric faces of a coaxial mounted annular or cylindrical magnetic body. Coils are inserted into said magnetic gap, while wound direction of two coils and the direction of current are decided to produce an electrodynamic force in the coils to the same direction. Said converter possesses resistance load characteristics by setting the values of the inductance of the two coils equal to each other in case that said converter are provided with two magnetic paths and coil circuits completely symmetric in their magnetic characteristics.

18 Claims, 7 Drawing Sheets

ENERGY CONVERTER WITH TWO COILS AND TWO MAGNETIC GAPS

CROSS REFERENCE TO RELATED APPLICATIONS

This application is a continuation (and claims the benefit of priority under 35 USC 120) of U.S. application Ser. No. PCT/CN00/00241, filed Aug. 18, 2000.

TECHNICAL FIELD

The present invention is related to the mechanic-electrical energy converter, especially to the converter with two coaxial magnetic gaps of the same diameters and two coils belonged to the field of mechanic-electrical energy converter in electricity.

BACKGROUND ART

In the prior art JP6-233380A had supposed a speaker with two magnetic gaps and two coils which has disadvantages of bulk volume, low sensitivity while the inductance of two coils cannot be cancelled and the speaker remains a non-lienear element with undisirable faithness. The main disadvantages of the speaker with two voice coils and two magnetic field presented by CN9426701.9 are: relatively large volume, low sensitivity while the inductance of two coils cannot be cancelled with short axial strokes of the coil not satisfied the requirement of speaker with large power and high voice level. In the prior art the permanent magnet is fixed to the yoke of adhesive which makes the magnetic path easy to be disconnected leading to damage of the speaker due to strong heating by vortex in the case of continuously inputting signal of big power.

Also use of adhesive to the permanent magnet and magnetic pole increased magnetic resistance of the magnetic path and the complexity of production.

DISCLOSURE OF THE INVENTION

The object of the invention is to provide an energy converter with two magnetic gaps and two coils which eliminates the disadvantages of the prior art, has the resistance load characteristic, high faithness, high sensitivity, small volume, good ventilation, long and extreme long strokes without adhesive between the permanent magnet and the yoke.

The object of the invention is achieved as follows:

A converter with two coils and two magnetic gaps comprising the magnetic path of permanent magnet and the frame integral with it, two coaxial annular magnetic gaps of the same diameters and a bobbin inserted into the magnetic gap on which the insulated wiring is parallelly wound to form two coils is characterized in that:

a) The upper and lower yokes of the said magnetic path are two coaxial and symmetric innerwardly concave plates made of magnetic material on the outer central portion of which a boss face is provided with a shaft hole which usually is a round hole, but can be a square or hexagonal hole;

b) The convex peripheral pole shoes are formed on the inner peripheries of the said upper and lower yokes, and a piece or more of the permanent magnets uniformly spaced with equal thickness and axial magnetization is provided between the pole faces of two peripheral pole shoes;

c) A hollow frame of non-magnetic material is embedded and bound to the inner face of the concave plates of the said upper and lower yokes with the inner vertical face of the permanent magnet mounted and bounded to the inner vertical face of the hollow frame;

d) Two pole faces of the said permanent magnet are engaged with the upper yoke and two pole faces of the peripheral pole shoes of the lower yoke; and a outer core of an integral magnetic path is formed by means of the through holes formed on the said boss faces of the upper and lower yokes, associated threaded holes, and the static pressure applied to the engaging pole faces by non-magnetic fasteners;

e) Two coaxial annular magnetic gaps of the same diameter are formed between the outer peripheric of the annular or cylindrical magnetic body coaxial with the central hole of the inner concave plates of the upper and lower yokes and the vertical peripheric of the central holes of the upper and lower yokes, also two coaxial coils are inserted into the said annular magnetic gap, while wound direction of two coils and the direction of current produce an electrodynamic force Fin the coils in the same moment and same direction;

f) With the dividing bisectrix x—x of half the axial highness of the said permanent magnet as the horizontal symmetric axis the said converter with two coils and two magnetic gaps has the symmetric magnetic path in geometry and magnetic characteristics, also the two coils have opposite wound directions after connecting in series while the section area of the wiring of the two coils, their turns and absolute value of the inductance are equal to each other with the said converter being a mechanic-electrical converter with resistance load characteristics.

g) The said coils and the central hole of the said inner concave plate are matched with the said annular or cylindrical magnetic body, with its optimum section being hexagonal and a short symmetric are provided on the top of inner corners of the hexagon or regular polygon while the arc is tangential to both sides of the inner corner and its center is located on the dividing line of the inner corner;

h) More than two uniformly spaced inner concave convection holes are provided on the peripheric pole shoes of the upper and lower yokes with the deepest bottom leveled with the inner face of the said inner concave plate;

i) Adhesive between the upper and lower yokes as well as the permanent magnet and the said hollow frame is cured after the outer core of the magnetic path has been assembled.

The said upper and lower yokes are two round inner concave plates, and the said permanent magnet is an annular permanent magnet or more than a piece of uniformly spaced sectorial or circular or annular rare metal permanent magnet.

The said upper and lower yokes are two inner concave plates with multi-sides and the permanent magnet is 3 or more than 3 pieces of uniformly spaced strip-like rare-metal permanent magnet with the same thickness.

The said upper and lower yokes are two rectangular inner concave plates and the permanent magnet is 4 pieces of uniformly spaced Strip-like rare-metal permanent magnets of the same thickness.

The upper and lower yokes and the vertical outer periphery of the permanent magnet are closed by two or more than two collars of driver made of non-magnetic material, the inner face of the collar and the yokes as well as the vertical outer face of the permanent magnet are engaged as an integral magnetic path; a bracket made of non-magnetic material with a hole in the central portion; and with the central axis as of the hole as symmetric axis, an inner convex boss face is formed on the outer side of the hole with an coaxial annular concave groove on the outer side of the said boss face; also a coaxial mounting face of the bracket engaged with the outer boss face of the lower yoke is provided on the outer side of the said annular concave groove, and coaxial annular or cylindrical magnetic body is mounted on the axial position of the said boss face by a set of non-magnetic fasteners, two coaxial annular magnetic gaps of the same diameters are formed between the outer periphery of the annular cylindrical magnetic body and the vertical periphery of the central hole of the upper and lower yokes, thus forming a complete magnetic path of the driver of the converter with two coils and two magnetic gaps.

A coaxial frame is connected with the said magnetic path with a coaxial open cylinder provided on the waist of the frame, coaxial annular concave groove is formed on the inner face of the bottom of the said cylinder with two coaxial annular boss faces provided on the inner and outer sides of the said annular groove, an inner convex cylinder of non-magnetic material is provided on the axial position of the middle annular boss face to fix the annular magnetic body on the said cylinder; a non-magnetic annular connecting plate closes the vertical faces of the upper and lower yokes, to embed the integral core of said magnetic path to the inner fitting face of the frame cylinder forming a integral unit with the frame.

A converter with two coils and two magnetic gaps comprising a magnetic path of permanent magnet and a frame integral with it, two coaxial annular magnetic gaps of the same diameters and a coil bobbin inserted in the magnetic gap on which the insulated wiring is parallelly wound to form two coils is characterized in that:

a) The upper and lower yokes of the said magnetic path are two coaxial and symmetric innerwardly concave plates made of magnetic material on the outer central portion of which a boss face is provided with a shaft hole which usually is a round hole, but can be a square or hexagonal hole;

b) The convex peripheral pole shoes are formed on the inner peripheries of the said upper and lower yokes, and a piece or more of the permanent magnets uniformly spaced with equal thickness and axial magnetization is provided between the pole faces of two peripheral pole shoes;

c) A hollow frame of non-magnetic material is embedded and bound to the inner face of the concave plates of the said upper and lower yokes with the inner vertical face of the permanent magnet mounted and bounded to the inner vertical face of the hollow frame;

d) Two pole faces of the said permanent magnet are engaged with the upper yoke and two pole faces of the peripheral pole shoes of the lower yoke; and a outer core of an integral magnetic path is formed by means of the through holes formed on the said boss faces of the upper and lower yokes, associated threaded holes, and the static pressure applied to the engaging pole faces by non-magnetic fasteners;

e) Two coaxial annular magnetic gaps of the same diameter are formed between the outer peripheric of the annular or cylindrical magnetic body coaxial with the central hole of the inner concave plates of the upper and lower yokes and the vertical peripheric of the central holes of the upper and lower yokes, also two coaxial coils are inserted into the said annular magnetic gap, while wound direction of two coils and the direction of current produce an electrodynamic force Fin the coils in the same moment and same direction;

f) The said coils and the central hole of the said inner concave plate are matched with the said annular or cylindrical magnetic body, with its optimum section being hexagonal and a short symmetric are provided on the top of inner corners of the hexagon or regular polygon while the arc is tangential to both sides of the inner corner and its center is located on the dividing line of the inner corner;

g) More than two uniformly spaced inner concave convection holes are provided on the peripheric pole shoes of the upper and lower yokes with the deepest bottom leveled with the inner face of the said inner concave plate;

h) Adhesive between the upper and lower yokes as well as the permanent magnet and the said hollow frame is cured after the outer core of the magnetic path has been assembled.

The said upper and lower yokes are two round inner concave plates, and the said permanent magnet is an annular permanent magnet or more than a piece of uniformly spaced sectorial or circular or annular rare metal permanent magnet.

The said upper and lower yokes are two inner concave plates with multi-sides and the permanent magnet is 3 or more than 3 pieces of uniformly spaced strip-like rare-metal permanent magnet with the same thickness.

The said upper and lower yokes are two rectangular inner concave plates and the permanent magnet is 4 pieces of uniformly spaced Strip-like rare-metal permanent magnets of the same thickness.

The upper and lower yokes and the vertical outer periphery of the permanent magnet are closed by two or more than two collars of driver made of non-magnetic material, the inner face of the collar and the yokes as well as the vertical outer face of the permanent magnet are engaged as an integral magnetic path; a bracket made of non-magnetic material with a hole in the central portion; and with the central axis as of the hole as symmetric axis, an inner convex boss face is formed on the outer side of the hole with an coaxial annular concave groove on the outer side of the said boss face; also a coaxial mounting face of the bracket engaged with the outer boss face of the lower yoke is provided on the outer side of the said annular concave groove, and coaxial annular or cylindrical magnetic body is mounted on the axial position of the said boss face by a set of non-magnetic fasteners, two coaxial annular magnetic gaps of the same diameters are formed between the outer periphery of the annular cylindrical magnetic body and the vertical periphery of the central hole of the upper and lower yokes, thus forming a complete magnetic path of the driver of the converter with two coils and two magnetic gaps.

A coaxial frame is connected with the said magnetic path with a coaxial open cylinder provided on the waist of the frame, coaxial annular concave groove is formed on the inner face of the bottom of the said cylinder with two coaxial annular boss faces provided on the inner and outer sides of the said annular groove, an inner convex cylinder of non-magnetic material is provided on the axial position of the middle annular boss face to fix the annular magnetic body on the said cylinder; a non-magnetic annular connecting plate closes the vertical faces of the upper and lower yokes, to embed the integral core of said magnetic path to the inner fitting face of the frame cylinder forming a integral unit with the frame.

A converter with two coils and two magnetic gaps comprising a magnetic path of permanent magnet and a frame integral with it, two coaxial annular magnetic gaps of the same diameters and a coil bobbin inserted in the magnetic gap on which the insulated wiring is parallelly wound to form two coils is characterized in that:

a) The upper and lower yokes of the said magnetic path are two coaxial and symmetric round plates made of magnetic material on the outer central portion of which a shaft hole, which usually is a round hole, but can be a square or hexagonal hole is provided;

b) Three or more sets of uniformly spaced permanent magnets of the same thickness are provided on the outer peripheric of the central hole of the said upper and lower yokes, each set of which is formed by 2 annular permanent magnets laminated in series and magnetized axially, and 4 pole faces of each set of permanent are directly engaged with two inner pole faces of the upper and lower yokes, the upper and lower yokes are connected by the static force applied to the engaged faces of each set of permanent magnets caused by the non-magnetic fasteners and also by the through holes formed on the axial portion of each set of annular permanent magnets on the upper and lower yokes, as well as threaded holes thus forming a outer core of integral magnetic path;

c) Two coaxial annular magnetic gaps of the same diameter are formed between the outer peripheric of the annular or cylindrical magnetic body coaxial with the central hole of the upper and lower yokes and the vertical peripheric of the central holes of the upper and lower yokes, also two coaxial coils are inserted into the said annular magnetic gap, while wound direction of two coils and the direction of current produce an electrodynamic force Fin the coils in the same moment and same direction;

d) With the dividing bisectrix x—x of half the axial highness of the said permanent magnet as the horizontal symmetric axis the said converter with two coils and two magnetic gaps has the symmetric magnetic path in geometry and magnetic characteristics, also the two coils have opposite wound directions after connecting in series while the section area of the wiring of the two coils, their turns and absolute value of the inductance are equal to each other with the said converter being a mechanic-electrical converter with resistance load characteristics.

e) The said coils and the central hole of the said round plate are matched with the said annular or cylindrical magnetic body, with its optimum section being hexagonal and a short symmetric are provided on the top of inner corners of the hexagon or regular polygon while the arc is tangential to both sides of the inner corner and its center is located on the dividing line of the inner corner;

f) Clearance is provided between the outer faces of uniformly spaced each set of permanent magnets, thus forming the convection ventilation path of the driver of the converter with two coils and two magnetic gaps.

A non-magnetic rigid bracket is provided with a shaft hole in the central portion, a coaxial inner convex boss face is formed on the outer side of the shaft hole, and a coaxial annular concave groove is formed on the outer side of the inner convex boss face also a mounting face of the bracket engaged with the outer boss face of lower yoke is provided on the outer side of the annular concave groove, a coaxial annular or cylindrical magnetic body is secured to the axial position of the inner convex boss face by a set of non-magnetic fasteners, and two coaxial annular magnetic gaps of the same diameters are formed between the outer peripheric of the annular or cylindrical magnetic body and the vertical periphery of the central hole of the upper and lower yokes, thus forming a complete magnetic path of the driver of the converter with two coils and two magnetic gaps.

A coaxial frame is connected with the said magnetic path with a coaxial open cylinder provided on the waist of the frame, coaxial annular concave groove is formed on the inner face of the bottom of the said cylinder with two coaxial annular boss faces provided on the inner and outer sides of the said annular groove, an inner convex cylinder of non-magnetic material is provided on the axial position of the middle annular boss face to fix the annular magnetic body on the said cylinder, and to embed the integral core of said magnetic path to the inner fitting face of the frame cylinder forming a integral unit with the frame.

A converter with two coils and two magnetic gaps comprising a magnetic path of permanent magnet and a frame integral with it, two coaxial annular magnetic gaps of the same diameters and a coil bobbin inserted in the magnetic gap on which the insulated wiring is parallelly wound to form two coils is characterized in that:

a) The upper and lower yokes of the said magnetic path are two coaxial and symmetric round plates made of magnetic material on the outer central portion of which a shaft hole, which usually is a round hole, but can be a square or hexagonal hole is provided;

b) Three or more sets of uniformly spaced permanent magnets of the same thickness are provided on the outer peripheric of the central hole of the said upper and lower yokes, each set of which is formed by 2 annular permanent magnets laminated in series and magnetized axially, and 4 pole faces of each set of permanent are directly engaged with two inner pole faces of the upper and lower yokes, the upper and lower yokes are connected by the static force applied to the engaged faces of each set of permanent magnets caused by the non-magnetic fasteners and also by the through holes formed on the axial portion of each set of annular permanent magnets on the upper and lower yokes, as well as threaded holes thus forming a outer core of integral magnetic path;

c) Two coaxial annular magnetic gaps of the same diameter are formed between the outer peripheric of the annular or cylindrical magnetic body coaxial with the central hole of the upper and lower yokes and the vertical peripheric of the central holes of the upper and lower yokes, also two coaxial coils are inserted into the said annular magnetic gap, while wound direction of two coils and the direction of current produce an electrodynamic force Fin the coils in the same moment and same direction;

d) The said coils and the central hole of the said round plate are matched with the said annular or cylindrical magnetic body, with its optimum section being hexagonal and a short symmetric are provided on the top of inner corners of the hexagon or regular polygon while the arc is tangential to both sides of the inner corner and its center is located on the dividing line of the inner corner;

e) Clearance is provided between the outer faces of uniformly spaced each set of permanent magnets, thus forming the convection ventilation path of the driver of the converter with two coils and two magnetic gaps.

A non-magnetic rigid bracket is provided with a shaft hole in the central portion, a coaxial inner convex boss face is formed on the outer side of the shaft hole, and a coaxial annular concave groove is formed on the outer side of the inner convex boss face also a mounting face of the bracket engaged with the outer boss face of lower yoke is provided on the outer side of the annular concave groove, a coaxial annular or cylindrical magnetic body is secured to the axial position of the inner convex boss face by a set of non-magnetic fasteners, and two coaxial annular magnetic gaps of the same diameters are formed between the outer peripheric of the annular or cylindrical magnetic body and the vertical periphery of the central hole of the upper and lower yokes, thus forming a complete magnetic path of the driver of the converter with two coils and two magnetic gaps.

A coaxial frame is connected with the said magnetic path with a coaxial open cylinder provided on the waist of the frame, coaxial annular concave groove is formed on the inner face of the bottom of the said cylinder with two coaxial annular boss faces provided on the inner and outer sides of the said annular groove, an inner convex cylinder of non-magnetic material is provided on the axial position of the middle annular boss face to fix the annular magnetic body on the said cylinder, and to embed the integral core of said magnetic path to the inner fitting face of the frame cylinder forming a integral unit with the frame.

SYMBOLS OF THE DRAWINGS

Pole surface—100,200,500,600,700,800,900
Frame—101,201,501,601,701,801,901,
Threaded hole for assembling of the frame—1061,2061, 5061,8061,9061
Recess fitting face—133,233,533,633,733,833,933
Annular concave groove—135,235,535,635,735,835,935,
Permanent magnet—102,202,502,602,702,802,902,
Upper yoke (lower yoke)—103,203,503,603,703,803,903,
Peripheric pole shoe of the yoke—129,229,529,629,729,829
Convection ventilation hole—117,217,517,717,917
Outer boss face of the upper (lower) yoke—10300,20300, 50300,60300, 70300,80300,90300
Inner profile face of the upper (lower) yoke—124,224,524, 624,724,824
Through hole of the upper yoke—1061,2061,5061,6061, 7061,8061,9061
Threaded hole of the lower yoke—1071,2071,5071,6071, 7071,8071,9071
Inner convex lip edge—1030,2030,5030,6030,7030,8030, 9030
Annular connecting plate—136,236,536,636,736,836,
Structure space—163,263,563,663,763,863,963,
Hollow frame—104,204,504,604,604,704,804
Outer profile face of the hollow frame—134,234,534,634, 734,834
Inner profile face of the hollow frame—173, 273,573,673, 773,873
Outer vertical face of the hollow frame—123,222,522,622, 722,822,922
Vibration membrane—106,206,506,606,706,806,906
Elastic hanging rim—199,299,599,699,799,899,999
Elastic damping plate—141,241,541,641, 741, 841, 941
Elastic damping plate—141,241,541,641,741,841,941
Coil bobbin—107,207,507,607,707,807,907
Coil—109,209,509,609,709,809,909
Annular support face—108,208,508,608,708,808,908
Annular support face—142,242,542,642,742,842,942
Annular concave groove—1630,2630,8630,6630,7630, 8830,9630
Annular magnetic gap—110,210,510,610,710,810,910
Inner convex boss face—111,211,511,611,711,811,911,
Inner convex cylindrical body—112,212,512,612,712,812, 912
Annular magnetic body—113,213,513,613,713,813,913
Central shaft hole—114,214,314,514,614,714,814,914,
Washer of the annular magnetic body—184,284,584,684, 784,884,984
Bracket—181,281,581,681,781,881,981
Through hole of the bracket—187,287,587,687,787,887,987
Outer inwardly concave face of the bracket—1811,2811, 5811,6811, 7811,8811,9811
Inwardly convex boss face of the bracket—1118,2118,5118, 6118,7118, 8118,9118
Bracket's mounting surface—1800,2800,5800,6800,7800, 8800,9800
Threaded hole of the bracket—188,288,588,688,788,888, 988
Nut—183,283,583,683,783,883,983
Collar of the driver—137,237,537,637,737,837
Inner concave groove of the collar—139,239,539,639,739, 839
Inner profile face of the collar—138,238,538,638,738,838
Ventilation hole of the collar—140,240,540,640,740,840, 840
Non-magnetic fastener—1000,2000,8000,5000,6000,7000, 9000
Non-magnetic bolt—181,281,881,681,781,881,981
Adhesive—001

PREFERRED EMBODIMENT OF THE INVENTION

Hereafter, the embodiments of the invention will be described according to the drawings.

Figure 2:
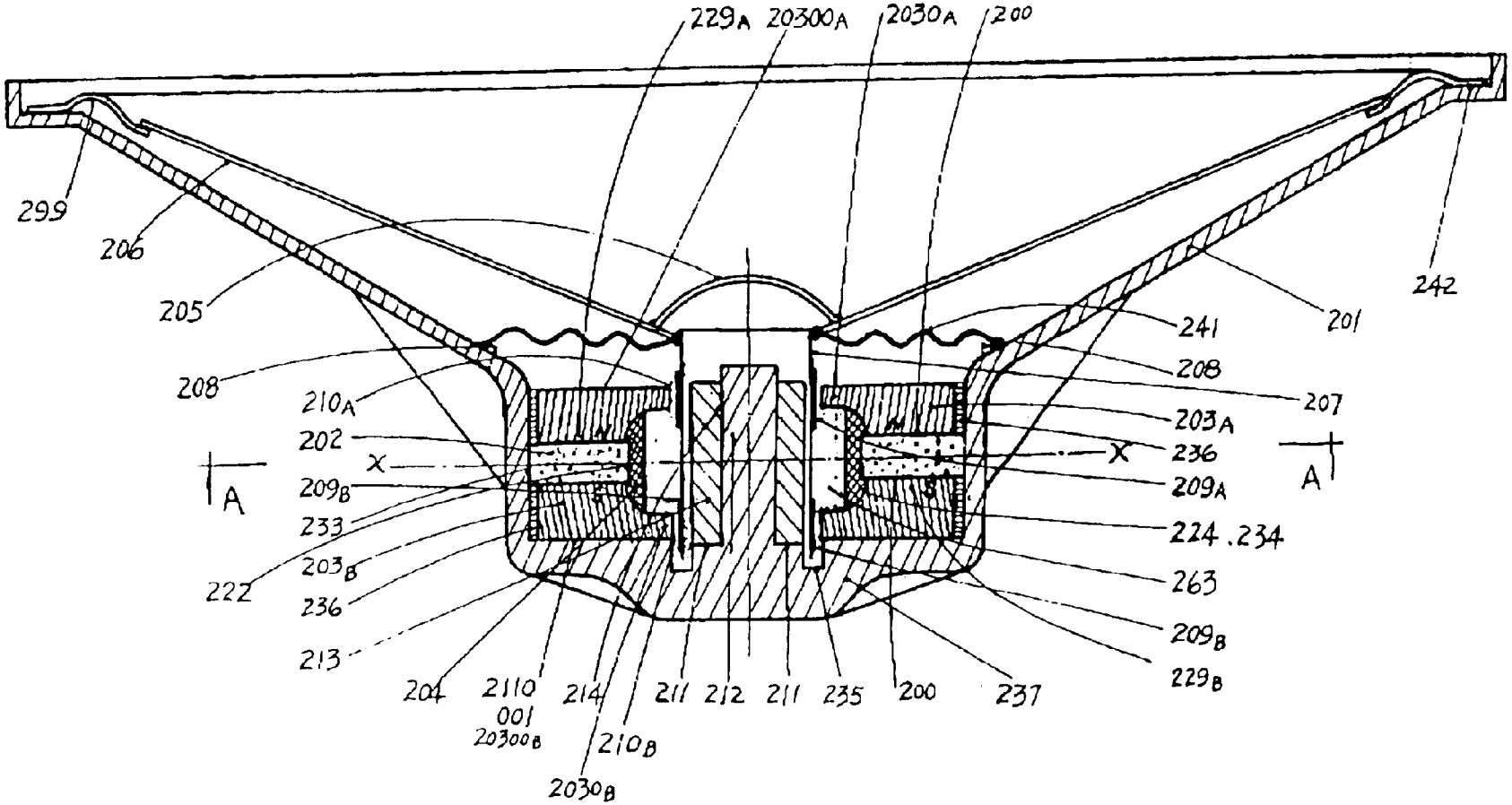
FIG. 2 is the longitudinal section view of the speaker according to the embodiment 2 of the invention.

FIG. 2 shows the longitudinal section view of the speaker according to embodiment 2 of the invention, The upper yoke 203A and the lower yoke 203B are two circular inwardly concave plates with equal projected planes and symmetrically disposed. A boss face 20300 with a central shaft hole 210 in the central portion is provided at the outer side of each concave plate. The convex peripheric pole shoes 229A and 229B are disposed on the inner periphery of the upper yoke 203A and lower yoke 203B. The hollow frame 204 of non-magnetic material is embedded between the upper yoke 203A and the inner profile face 224 of the lower yoke 203B. The outer profile face 234 of the hollow frame 204 and the inner profile face 224 of the upper and lower yokes are engaged with each other and applied with adhesive 001. The outer vertical face 222 with adhesive 001 applied there to in advance is provided in the middle of the outer profile of the hollow fame 204. The inner vertical face of the permanent magnet 201 is positioned by the outer vertical face 222 of the hollow frame. Between pole faces 200 of the peripheric pole shoes 229A and 229B of the upper. Lower yokes 4 uniformly spaced sectorial rare-metal permanent magnets 202 with the same thickness, areas, volume and magnetic properties are arranged with their pole faces 200 directly engaged with the pole faces of the peripheric pole shoes. Three or more uniformly spaced through holes 2061 (not shown in FIG. 2, and may be referred to the threaded hole 2071 in FIG. 3) are provided along the outer side of the shaft hole on the plate between the central shaft hole 210A of the upper yoke and the boss face 20300A. And three or more uniformly spared threaded holes 2071 corresponding to the through hole 2061 (not shown in FIG. 2, may be referred to FIG. 3) are provided on the plate between the central shaft hole 210B of the lower yoke 203B and the boss face 20300B. Some static pressure is applied to the engaged pole faces 200 of the upper yoke 203A, lower yoke 203B and permanent magnet 202 via 3 or more matching non-magnetic fasteners (e.g. copper screw). After curing of the adhesive 001, an integral magnetic path of the speaker with small magnetic resistance is obtained without adhesive applied between the permanent magnet and the engaged pole faces of the upper and lower yokes. For facilitating the assembly work the annular connecting plates 236 made of non-magnetic material with the outer diameter equal to that of the permanent magnet 202 are bound to the outer vertical faces of the upper yoke 203A and lower yoke 203B (sometimes it is possible to provide one annular connecting plate on the upper, lower yokes and the outer vertical faces of the permanent magnet, then fix then with adhesive 001). Therefore, an outer core of the magnetic path of the speaker is formed.

In order to exert the merit of the high magnetic energy product of the neodymium magnet, the thin pieces of the neodymium magnet are saturated in advance in the embodiment, and then embodied between the peripheric pole shoes of the upper yoke 203A and lower yoke 203B. The detail description of which can be found in the patent application WO 98/47312 of the inventor. (It is no doubt that the permanent magnet may be magnetized after an integral magnetic path is formed by binding the upper yoke 203A, lower yoke 203B, permanent magnet 202, hollow frame 204 and the annular connecting plate 236).

The speaker is provided with frame 201 made of non-magnetic rigid material (for example aluminum alloy) which is shaped cylindrical below its waist. An inwardly convex boss 211 is provided on the axial bottom of the cylinder which is an annular horizontal surface symmetric with respect to the central axis of the shaft hole 210. In the upper middle portion of the cylinder a concave matching face 233 is formed which is coaxial and perpendicularly intersected with the inwardly convex boss face 211. A coaxial annular concave groove 235 is formed on the outer side of the inwardly convex boss face 211 which provides the coil bobbin 207 of the speaker with sufficient space to move down. An annular boss face 2110 is also provided on the outer side of the annular concave groove 235 which is also coaxial and perpendicularly intersected with the concave matching face 233.

After the outer core of the magnetic path of the driver comprised of the upper yoke 203A, lower yoke 203B, permanent magnet 202, hollow frame 204 and the annular connecting plate 236 has embedded from the outside of the frame 201 in the concave matching face 233 cylinderically shaped in the middle of the frame, an annular magnetic body 213 formed of magnetic material is embedded in the inwardly convex cylindrical body 212 disposed in the axial portion of the inwardly convex boss face 211, and than is bound to the convex boss face 211. The inwardly convex cylindrical body 212 of the non-magnetic material may be integrally formed while casting the frame 201 of aluminum alloy, or may be fixed to the bottom of the frame cylinder by means of non-magnetic fasteners. It can be seen from FIG. 13 that the diameters of the central shaft holes of the upper yoke 203A and the lower yoke 203B are less than the diameter of the projected plane of the 4 uniformly spaced sectorial permanent magnets 202. Therefore uniform inner lip edges 2030A and 2030 B are protruded along the radial inner side from the coaxial inner concave plate, between the inner vertical periphery of which and the outer periphery of the coaxial annular magnetic body 213 two annular magnetic gaps 210A and 210B with equal diameters are formed. Two independent coils 209A and 209B are wound on the cylindrical coil bobbin 207 with the upper end of which bound with the vibration membrane of the speaker 200, and the elastic damping plate 241. The elastic rim 299 of the membrane 206 and the other end of the damping plate 241 are bound to the annular support faces 242 and 208 provided by the frame 201 respectively. The polarity after magnetization of the permanent magnet 202 is shown in FIG. 2. By way of example of the left magnetic path from the central line of the speaker in FIG. 2, the closed magnetic path is formed by the magnetic lines of the permanent magnet through N pole of 202→203A→210A→209A→210→213→210B→209B→210B→203B-9 pole of 202. Compared with the annular plate and T-shaped iron magnetic path of the traditional speaker the invention eliminates the T-shaped iron for switching the direction of the magnetic lines by 90° □ thus the equivalent inductance and the-flux leakage of the magnetic path are significantly reduced, and the electric—voice converting efficiency is greatly increased.

Referring to the left side of the magnetic path it can be seen, that the magnetic lines of the upper magnetic gap 210A pass through the coil 209*a* from left to right, and the magnetic lines of the lower magnetic gap 210B pass through the coil 209*a* from the right. Directions of both magnetic lines have 180° phase changes. Therefore, if the two coils 209A and 209B are wound in opposite directions, then at the same moment when both the coils are connected to an audio current, the electrodynamic forces FA and FB of both coils have the same directions, thus the electrodynamic force of the speaker's coil F=FA+FB. In the case of reversed phase of the audio current, the directions of FA and FB are reversed and the electrodynamic force of the speaker F=FA+FB remains unchanged with its direction just opposite.

When the coils 209A and 209B are parallelly connected in opposite directions, the equivalent inductance will reduced by half, leading to remarkable improvement of the response curve of the impendence VS frequency.

During the continuous operation of the speaker under the large audio current, the upper yoke 203A, lower yoke 203B and the annular magnetic body 213 will expand due to vortex heating. However, owing to the adhesive positioning of the upper yoke 203A, outer vertical face of the lower yoke 203B, the annular connecting plate 236 and the frame 201, as well as the adhesive positioning of the inner vertical face of the permanent magnet 202 and the outer vertical face 222 of the hollow frame 204, the adhesive 001 on the positioning portions is only subjected to tension or compression stress in vertical direction, thus the adhesive 001 obtains its maximum strength. The horizontal displacement the upper and lower yokes does not occur in this case, so is the case with the annular magnetic body.

The structure space formed by the upper and lower yokes as well as the inner vertical face of the hollow frame 204 decreases the damping of the axial movement of the vibration membrane of the speaker, increasing the transient response velocity of the speaker and improvement of the ventilation of the coils.

Figure 3:
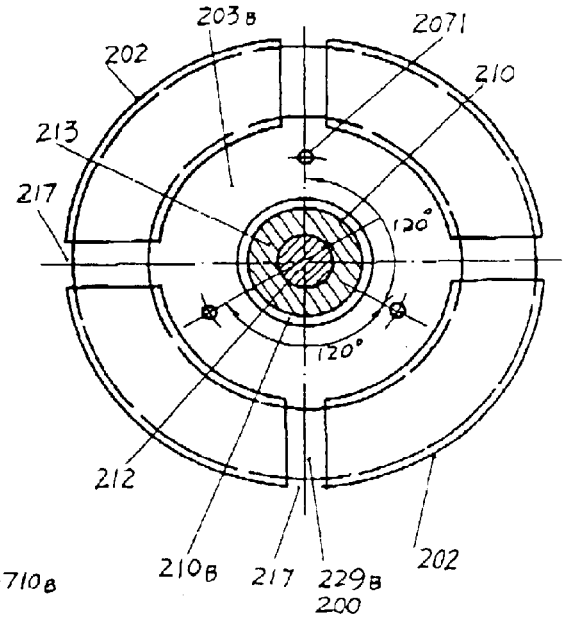
FIG. 3 is the plan section view of the magnetic path A—A according to embodiment 2 of the invention.
Figure 12:
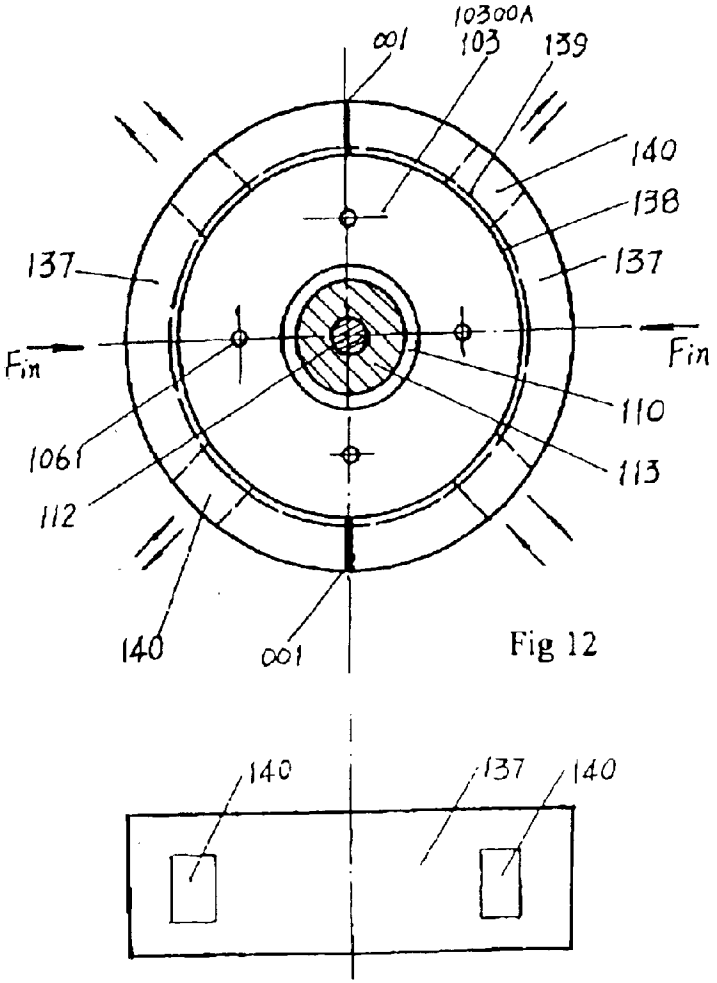
FIG. 12 is the plan and perspective view of the driver with a collar according to embodiment 1 of the invention.

4 convection holes 217 are provided on the pole shoes at the intervals of adjacent two permanent magnets. The bottom of the holes are levelled with the inner bottom of the upper and lower yokes as shown in FIG. 3 and FIG. 12.

Figure 1:
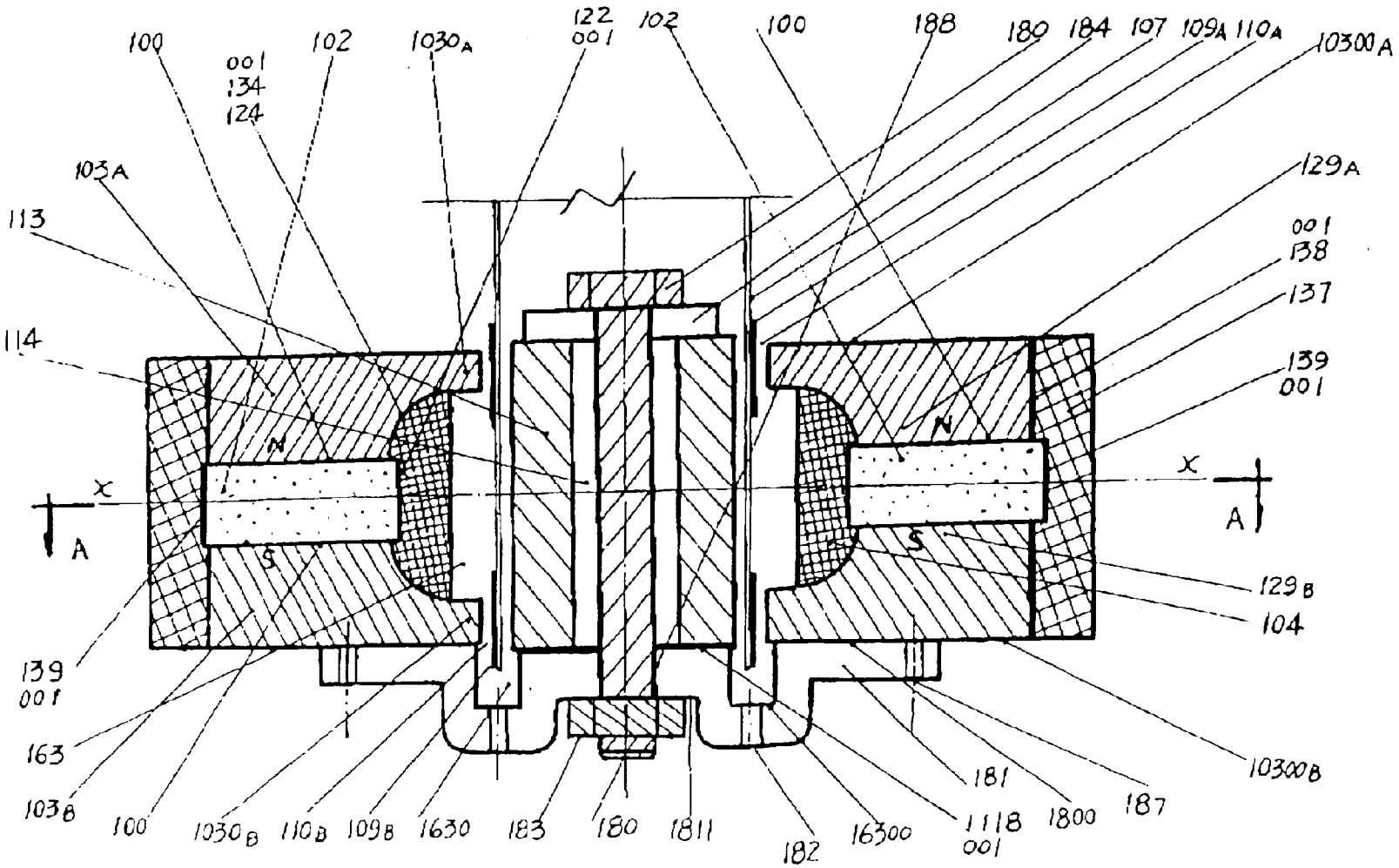
FIG. 1 is the longitudinal section view of the driver of the mechanic-electrical according to the embodiment 1 of present invention.

FIG. 1 shows the longitudinal section view of the mechanic-electrical converter of the embodiment 1 of the invention. An integral magnetic path is formed by the upper yoke 103A, lower yoke 103B, permanent magnet 102, hollow frame 104 connected by means of adhesive 001 and the through hole 1061 of the upper yoke, threaded hole 1071 of the lower yoke and non-magnetic fasteners 1000, in the same manner as the embodiment 2 in FIG. 2. Thus its description is omitted.

Since the high value of the Br value of the rare-metal permanent magnet (such as neodymium-boron magnet) and its maximum magnetic energy product, therefore the gradient of the magnetic field of the leakage flux on the outer face of the converter is high. It's a result of abstraction of the ferrous magnetic substance to the surface of the driver, the flux density within the annular magnetic gap of the driver is decreased. In addition, the rare-metal magnet such us neodymium-boron is easily damaged by mechanical impact due to its brittleness. In order to soft this problem the magnetic path is covered by two driver collar 137 of non-magnetic material along the upper yoke 103A, lower yoke 103B and the vertical outer face of the permanent magnet 102 in this embodiment. The collar 137 is pressure-casted with plastics. The concave groove 139 of the collar fitted with the outer vertical face of the permanent magnet 102 is provided on the inner face 138 of the collar 137. Adhesive 001 is applied in advance to the inner face 138 or the outer vertical face of the magnetic path, and simultaneously the static force Fin is applied to the collar 137 from outside as shown by the arrows in FIG. 12. Adhesive 001 an force Fin are also applied to the coupling face of each collar, so a mechanic-electrical converter of high strength is obtained after curing of the adhesive. The same driver can also be formed usely the through hole or threaded hole in the coupling portous of two collar 737 and fasteners made of non-magnetic material.

Difference with the embodiment 2 is as follows: the bracket 181 formed of non-magnetic pressure-casted aluminum alloy has a coaxial and symmetric annular mounting surface 1800 on which 4 uniformly spaced through holes 187 are arranged. With 4 bolts the bracket 181 is fixed to the axial position on the outer boss face 1030B of the lower yoke. A shaft hole 188 is provided in the center of the bracket 181 with a coaxial inwardly convex boss face 1118 at the outer side. A coaxial annular concave groove 1630 is formed in the outer side of the boss face 1118. The annular is extending outwardly (downwardly) to form a space for the coil bobbin of the converter to be moved downwardly. An washer 184 of the annular magnetic body made of non-magnetic material is mounted on the upper end of the annular magnetic body 113 with a non-magnetic bolt 180 passed through lower end of the magnetic body 113 to be fixed on the axial position of the boss-face 1118 of the bracket 181. Two coaxial annular magnetic gaps 110A and 110B with the same diameters are formed between peripheric surface of the annular magnetic body 113 and the vertical face of the shaft hole of the upper yoke 103A and lower yoke 103B. A coil bobbin 107 with two coils 109A and 109B wound in opposite directions is inserted into the two annular magnetic gaps to form the driver of the mechanic-electrical converter using the bracket structure.

The frame of the vibration membrane of the embodiment may be directly mounted on the outer boss face 10300A of the upper yoke 103A by bolts, like the traditional conical frame of aluminum alloy. Also the vibration membrane and the associated plate may be directly mounted on the outer boss face 10300A, like the traditional semi-spherical high volume vibration membrane and its frame of the speaker.

Figure 11:
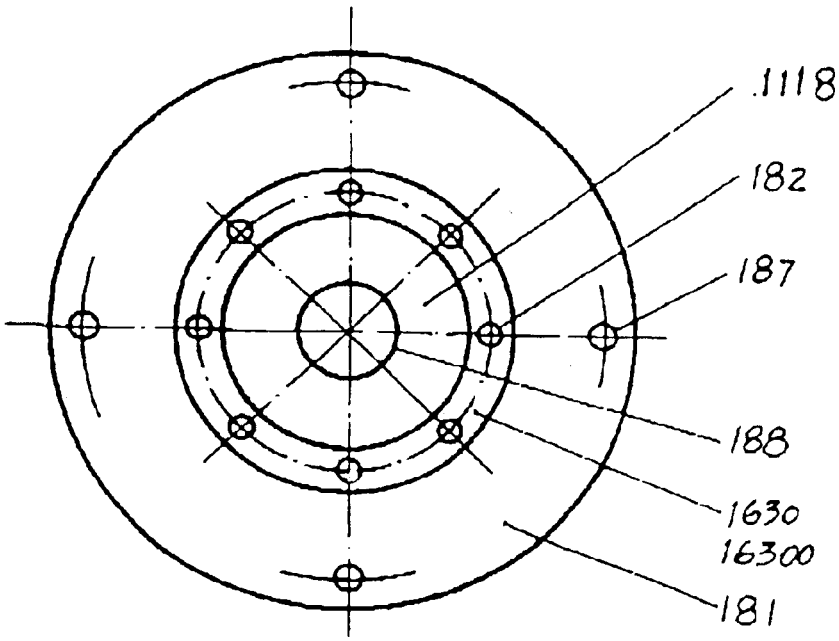
FIG. 11 is the plan view of the bracket of the embodiment 1 of the invention.

In order to reduce the damping of axial improvement of the converter and improve the ventilation of the coils some uniformly spaced air holes 182 of the bracket are provided on the bottom 16300 of the annular concave groove of the bracket, as shown in FIG. 11.

The structure and principle are similar to that to embodiment 2 of FIG. 2, so the description is omitted.

FIG. 3 shows the plan section view of the magnetic path A—A of embodiment 2 of the invention The upper yoke 203A and lower yoke 203B of the speaker are two coaxial and symmetric round concave plates. 4 pieces of sectorial thin pieces 202 of the neodymium magnet with the same magnetic characteristic, thickness, areas and volumes are embedded between the pole faces 200 of the peripheric pole shoes 229A and 229B of the yokes. Clearance and convection holes 217 on the sides are provided on the ends of each magnet. 4 corresponding convection air holes 27 with bottoms levelled with the inner face of the concave plate are formed on the peripheric pole shoes 229A and 229B of the upper yoke 203A and lower yoke 203B. The hollow frame 204 is omitted in the fig.

The reminder portions are the same as that of embodiment 1 and 2, so they are not repeated here.

Figure 4:
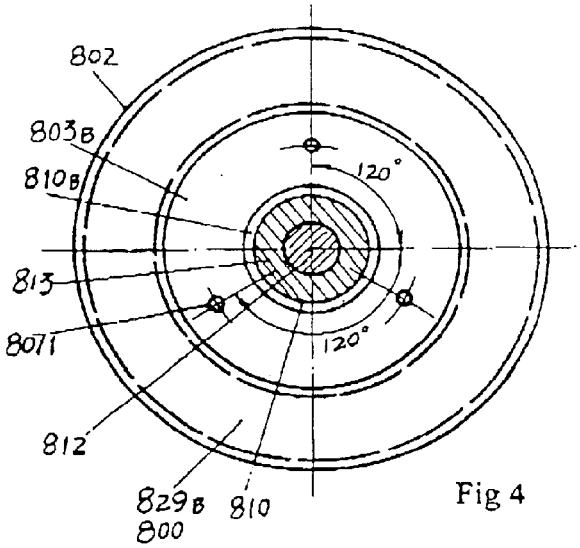
FIG. 4 is the plan section view of the magnetic path A—A according to embodiment 3 of the invention.

FIG. 4 shows the plan section view of the magnetic path A—A of the embodiment 3.

The upper yoke 803A and lower yoke 203B of the converter are two coaxial and symmetric round concave plates. The permanent magnet 802 is an annular neodymium magnet embedded between the pole faces 800 of the peripherical pole shoes 829A and 829B of the yokes. Three uniformly spaced through holes 806 on the boss face 804 of the upper yoke and three corresponding threaded holes 807 on the boss face 804 of the lower yoke are for use of three non-magnetic fasteners to connect the magnetic path of the driver of the converter. The hollow frame 804 is omitted in the fig.

The rest is similar to that of the embodiment 1, so it is not repeated here.

Figure 5:
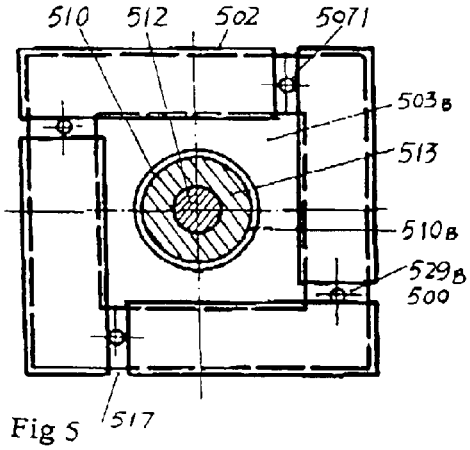
FIG. 5 is the plan section view of the magnetic path A—A according to embodiment 4 of the invention.

FIG. 5 shows the plan section view of the magnetic path A—A of the embodiment 4.

The upper yoke 503A and lower yoke 503B of the mechanic electrical converter are two coaxial and symmetric square concave plates. 4 pieces of sectorial thin pieces 502 of the neodymium magnet with the same magnetic characteristic, thickness, areas and volumes are embedded between the pole faces 500 of the peripheric pole shoes 529A and 529B of the yokes. Clearance and convection holes 517 on the sides are provided on the ends of each magnet. 4 uniformly spaced through hoes 5061 and associated threaded holes 5071 are provided on the peripheric pole shoes 529A and 529B of the yokes for the 4 non-magnetic fasteners to connect the magnetic path of the driver of the converter. The hollow frame 504 is not shown in the fig.

The remainder is similar to that of the embodiment 1 and 2, so it is not repeated here.

Figure 6:
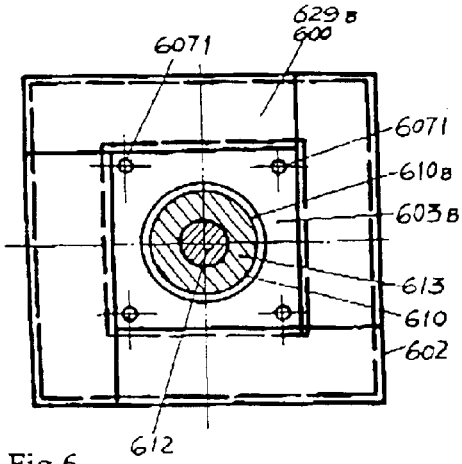
FIG. 6 is the plan section view of the magnetic path A—A according to embodiment 5 of the invention.

FIG. 6 shows the plan section view of the magnetic path A—A of embodiment 5.

The upper yoke 603A and lower yoke 603B of the mechanic electrical converter are two coaxial and symmetric square concave plates. 4 pieces of sectorial thin pieces 602 of the neodymium magnet with the same magnetic characteristic, thickness, areas and volumes are embedded between the pole faces 600 of the peripheric pole shoes 629A and 629B of the yokes. 4 uniformly spaced through hoes 5061 and associated threaded holes 5071 are provided on the boss face of the upper yoke 603A for the 4 non-magnetic fasteners to connect the magnetic path of the driver of the converter. The hollow frame 504 is art shown in the fig.

Figure 7:
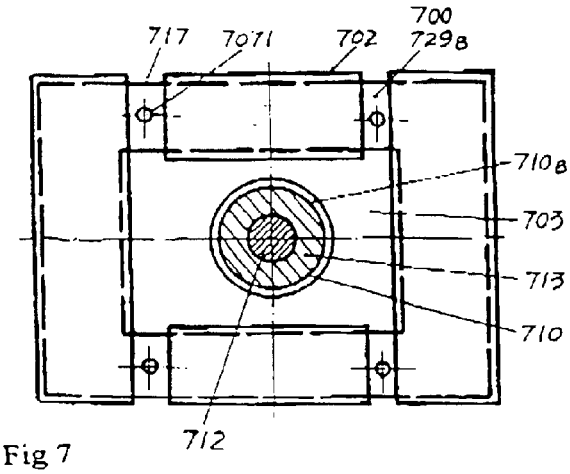
FIG. 7 is the plan section view of the magnetic path A—A according to embodiment 6 of the invention.

FIG. 7 shows the plan section view of the magnetic path A—A of embodiment 6.

The upper yoke 703A and lower yoke 703B are two coaxial and symmetric rectangular concave plates. Two big strip-like neodymium magnets 702 of the same areas, volumes and magnetic characteristic are arranged on the short sides of the rectangle. 4 permanent magnets have the same thickness. Suitably secting the size of the permanent magnet on the long sides allows to obtain the uniform flux density inside the annular magnetic gap 710 of the driver. 4 uniformly spaced through holes 7061 and associated threaded holes 7071 are formed on the peripheric pole shoes 729A and 729B of the yokes for the use of 4 non-magnetic fasteners to connect the magnetic path of the driver The hollow frame 704 is not shown in the fig.

The remainder is the same as in embodiment 1,2, so it is not repeated here.

Figure 8:
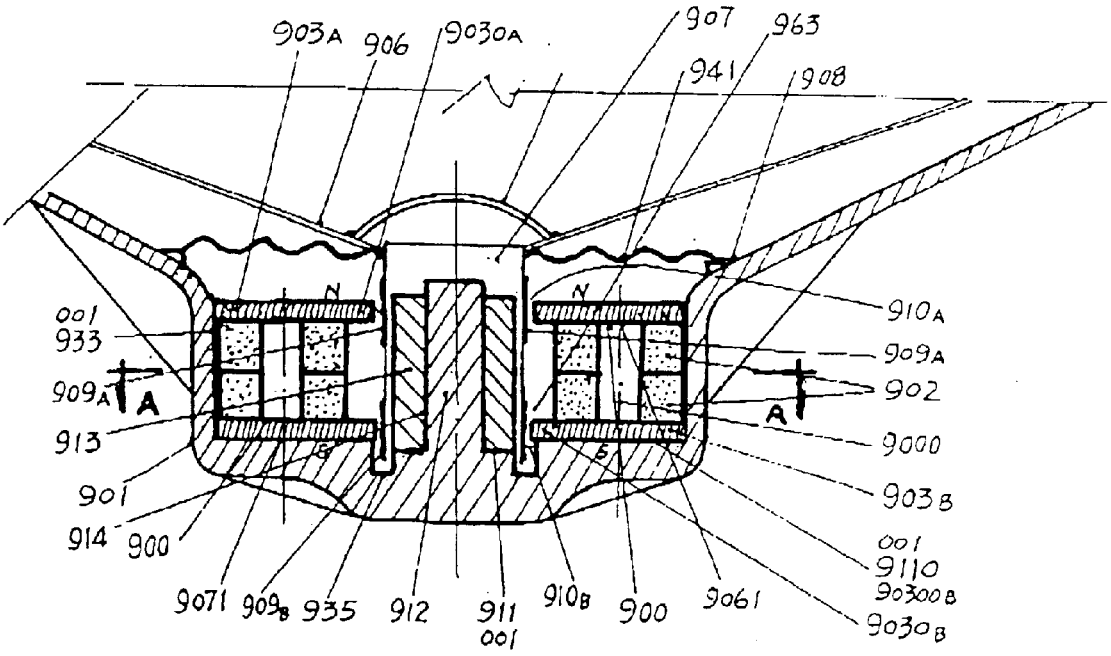
FIG. 8 is the longitudinal section view of the speaker according to embodiment 7 of the invention.

FIG. 8 shows the section view of the speaker of the embodiment 7.

The structure of the frame 901 is similar to that of the frame 201 of the embodiment 2 which can not be repeated here.

The structure of the magnetic paths of the speakers in embodiment 7 and 2 are different. The upper yoke 903A and the lower yoke 903B are two coaxial and symmetric round plates with a central shaft hole 910 at the center of the plate. 8 sets of uniformly spaced permanent magnets are provided on the outer peripheries of the upper and lower yokes with each set of magnets formed by lamination in series of two annular ferrite permanent magnets of the same projected areas, volumes and magnetic characteristics. Each annular ferrite permanent magnet has the same thickness and diameter of the shaft hole. 8 through holes 9061 of the upper yoke 903A and 8 threaded holes 9071 of the lower yoke 903B (not shown) are matched with shaft holes. Using 8 non-magnetic fasteners 9000 (such as copper bolt) to apply uniform static pressure in advance to the upper yoke 903A, lower yoke 902*b* and the engaged face 900 of 8 sets laminated annular permanent magnets the outer core of the integral magnetic path is formed. Embedding the core of the magnetic path from the outer side of frame 901 to the recess fitting face 933, the outer vertical face of the core and outer face 90300B of the lower yoke 903B are bound by adhesive 001 with the recess fitting face 933 and the annular (P21) An annular magnetic body 913 is mounted on the inner cylindrical body 912 on the axial position of the convex boss face 911 of the frame 901 . . . thus two uniform annular magnetic gaps 910A and 910B are formed between the inner vertical faces of the central shaft holes 910 of the upper yoke 903A and lower yoke 903B and the outer periphery of the annular magnetic body 913. Two coils 909A and 909B are wound on a cylindrical coil bobbin 907 which are bound together with the elastic damping plate 941, vibration membrane 906 and coil bobbin 907. The structure principle of operation and effect are the same as in embodiment 1 and 2, which will not be repeated here.

Figure 9:
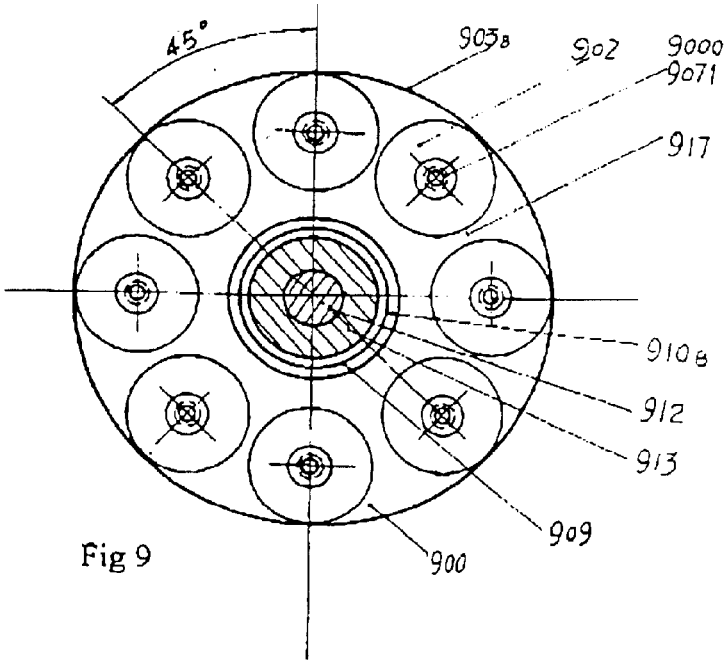
FIG. 9 is the plan section view of the magnetic path A—A according to embodiment 7 of the invention.

FIG. 9 shows the plan section view of the magnetic path A—A of the embodiment 7.

The upper yoke 903*a* and lower yoke 903B of the speaker are two coaxial and symmetric round plates made of magnetic material with a central hole 910 in the center and 8 through holes 9061 (upper yoke) and 8 threaded holes 9071 (lower yoke) uniformly provided along the periphery of the central hole. The angle between the adjacent two through holes or the angle of the axes of the threaded holes is 45 degree. 8 sets of annular permanent magnets fitted with the through holes 9061 and threaded holes 9071 are uniformly spaced between the inner faces 900 of the upper and lower yokes, and convection path 917 is provided between two adjacent sets of permanent magnets. The rest is similar to that of the embodiments 1,2, so it is not repeated here.

In order to improve ventilation a vent or grid may be provided with correspondence with the convection path 917.

Combination of the outer core of the magnetic path with the bracket and annular magnetic body of the embodiment 1 shown in FIG. 1, and at the same time assembly of the traditional frame of converter (such as the conical bracket of the speaker or the vibration membrane of the semi-spheric high volume speaker and its frame) on the outer boss face 90300A of the upper yoke 903A allow to construct converters with round plates.

Figure 10:
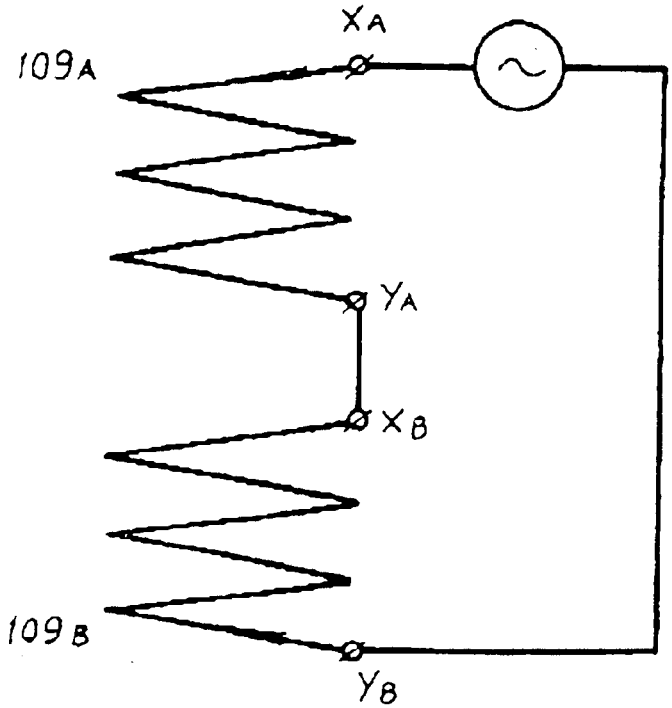
FIG. 10 is the principle wiring scheme of the circuit of the mechanic-electrical converter with resistance load characteristic.

FIG. 10 shows the wiring scheme of the circuit of the mechanic-electrical converter with resistance local characteristics.

The embodiment is described according to the embodiment 1 and FIGS. 1 and 2.

The requirements of the embodiment are:

The materials and geometry of the upper yoke 103A and lower yoke 103A are similar, the geometry and the magnetic induction intensity Br of the two annular magnetic gaps 110A and 110B are identical, two coils 109A and 109B are wound in opposite directions, the section areas of the wiring of the coils are equal to each other, the turns of two coils are the same Na=Nb, and the absolute values of the inductance of two coils are identical |L109A|=|L109B|. That is to say, with the section line X—X at the axial high of the permanent magnet 102 as the horizontal symmetric axis (ref to FIG. 1), the converter has a pair of symmetric magnetic paths in geometry and magnetic characteristics.

Connected in series the rear and YA of the coil 109A and the head and YB of the coil 109B, the said real end and head end constitute a pair of signal input terminals of the converter, Since the two coils 109A and 109B operate in same flux loop, their inductance vectors are cancelled due to the 180 degree phase difference with the electro-dynamic force of the coil F=F109A+F109B, Therefore, the distortion of the phase of the converter with resistance load characteristics can be eliminated.

The wiring scheme of the circuit of the embodiment and the principle of setting the symmetric magnetic path can be applied to all the embodiments of the invention. By combination of various magnetic paths and circuits. Person with ordinary skill in the art can obtain the mechanic-electrical converter with various structures and resistance load characteristics according to the invention.

FIG. 11 is the plan view of the bracket of the embodiment 1 of the invention.

The bracket is provided with a shaft hole 188 on the outer side of which a coaxial annular inner convex boss face 1118 in formed. A coaxial annular concave groove 1630 is provided on the outer side of boss face 1118 and at the bottom 1630 of the concave groove 8 uniformly spaced bracket holes 182 are formed. When the coil bobbin 107 of the converter vibrates up and downward, the holes 182 reduce the damping of the bobbin and improve ventilation of the coil. A coaxial mounting surface 1800 of the bracket is formed on the outer side of the annular concave groove 1650 which is a smooth annular mounting surface engaged with the outer boss face 10300 B of the lower yoke. On the mounting surface 1800 4 through holes 182 are uniformly spaced which fix the bracket 181 on the lower yoke with the help of bolts (ref to embodiment 1 of FIG. 1, it ignore repeated here).

The similar brackets 281, 981 of the embodiment can be matched with any type of the magnetic path of the converter to construct various drivers of the converter.

FIG. 12 shows the plan and perspective view of the collar of embodiment 1.

In the embodiment the collar 137 of the driver is composed of two semi-circular plastic sections. Adhesive 001 is applied to the inner face 138 of the collar which then is bound to the upper yoke 103A, lower yoke 103B, and the outer vertical face of the permanent magnet 102. In order to correspond with the magnetic path of FIG. 1 and improve ventilation of the converter, two rectangular vents 140 are formed on each collar 137 which match the convection air holes 117 provided on the peripheric pole shoes 129A and 129 B of the upper and lower yokes. Adhesive 001 is applied to the coupling face of two collars. Arrow Fin indicates the direction of static pressure during assembling of the driver of the converter.

The remainder portions can be found in embodiment 1 and 2, thus they are omitted here.

The similar collars of driver 237 . . . 837 of the embodiment can be matched with any type of the magnetic path of the converter and form various drivers of the converter.

Figure 13:
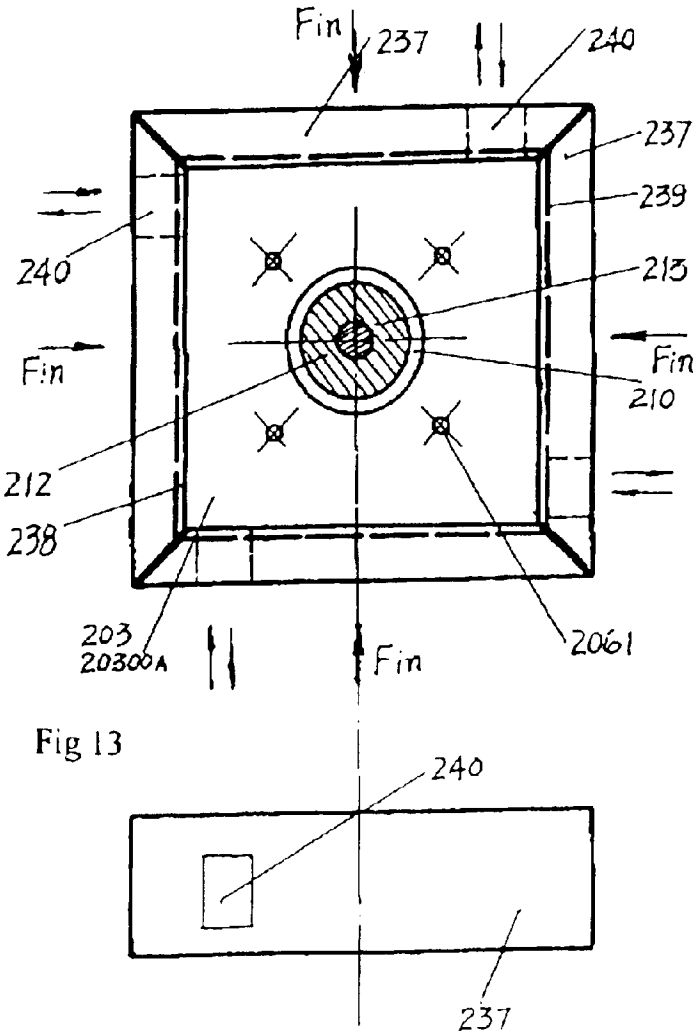
FIG. 13 is the plane and perspective view of the driver with a collar according to embodiment 2 of the invention.

FIG. 13 shows the plan and perspective view of the collar of the embodiment 2 of the invention.

It has a square yoke and the structure of the magnetic path is the same as embodiment 4 in FIG. 5. The collar of the driver is formed by a strip-like collars 237. Adhesive is applied to the inner face of the collar and the coupling face of the adjacent collar. An arrow Fin indicates the direction of the static pressure applied to the collar. In order to improve ventilation of the speaker a vent 240 can be formed on each collar which matches with the convection hole 517 of the yoke in embodiment 4 of FIG. 5.

The remainder is similar to that of the embodiment 1 and 2, it is not repeated here.

Figure 14:
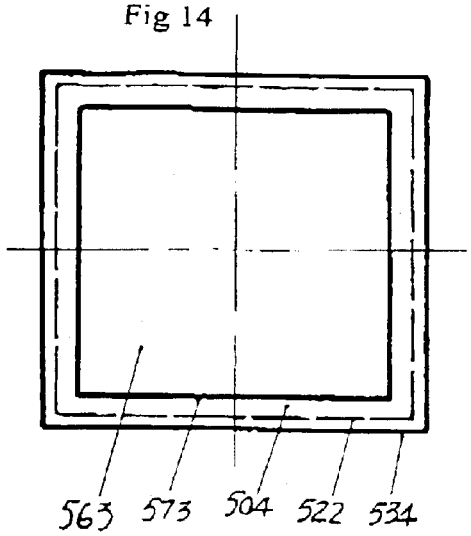
FIG. 14 is the plan view of an embodiment of the hollow frame of the invention.
Figure 14:
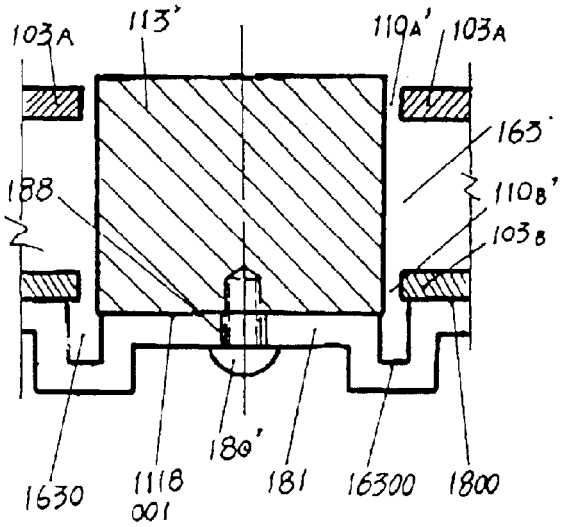

FIG. 14 shows a plan view of an embodiment of the hollow frame of the invention.

The square hollow frame 504 is pressure-casted by non-magnetic materials, such as rigid plastics. The frame is provided with an outer face 534 which is engaged and bound with the inner face of the upper and lower yokes. An outer vertical face 522 is provided on the middle portion of the outer face which is engaged and bound with the inner vertical face of the permanent magnet 502. The structure space 563 is formed between the smooth vertical inner face 573 and the annular magnetic body of the converter or it's outer periphery. The rest can be referred. To the embodiments 1 and 2, as well as FIGS. 2, 5 and 6.

Figure 15:
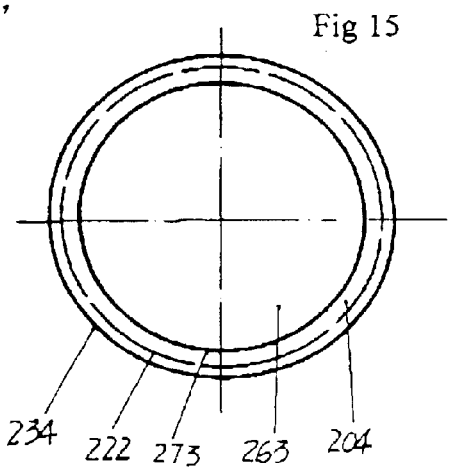
FIG. 15 is the plan view of another embodiment of the hollow frame of the invention.

FIG. 15 shows a plan view of the hollow frame of the invention.

The annular hollow frame 204 is fitted with the embodiment 2 of FIG. 2, and it is not repeated here.

Figure 16:
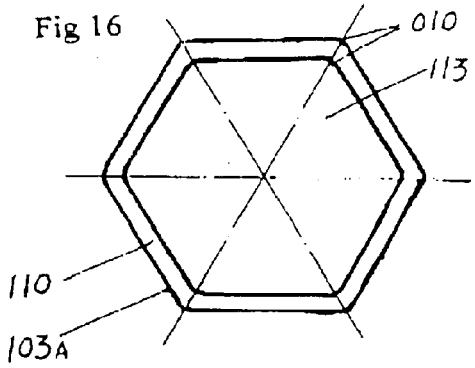
FIG. 16 is the schematic plan view of an embodiment of a hexagonal magnetic gap of the invention.

FIG. 16 shows a plan view of an embodiment of the hexagonal magnetic gap.

Figure 17:
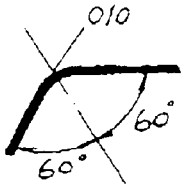
FIG. 17 is the schematic plan view of an embodiment of a hexagonal magnetic gap and the arc section of the internal corner of the hexagonal annular magnetic body of the invention.

The cylindrical magnetic body 113 of the converter of the embodiment is a cylindrical yoke with hexagonal section. The upper yoke and lower yoke hole 103 is a hexagonal hole matched with the cylindrical magnetic body 113, thus a hexagonal annular magnetic gap 110 is formed. Since the hexagon's side length is maximum, thus compared with the coil (not shown) are able to gain the maximum electro—dynamic force and ventilation effect. From FIG. 17 it can be seen, that a short symmetric arc 010 is provided on the top of inner corner of each hexagon which is tangential to the two sides of the inner corner with its center located on dividing line of the inner corner.

Figure 18:
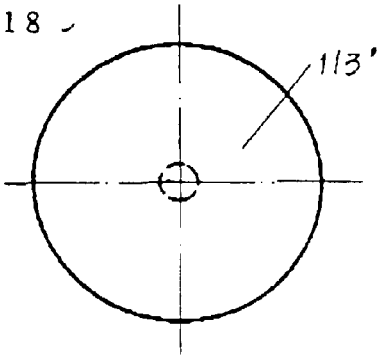
FIG. 18 is the schematic plan and perspective view of an embodiment of the cylinderical body of the invention.

FIG. 18 shows a schematic plan and perspective view of the nodes of an embodiment of the cylindrical magnetic body.

Compared with FIG. 1 of embodiment 1 it can be seen that a cylindrical magnetic body 113' has replaced the annular one 113 and the body 113' is mounted on the inner convex boss face 118 of the bracket 181 by bolt 180' passing through the hole 188 of the bracket and adhesive 001. The cylindrical magnetic body 113' and the hole 110 of the upper and lower yokes form two annular magnetic gaps 110A' and 110B'. The rest portions can be referred to the embodiments 1 and 2, thus it is not repeated here.

It should be noted that combination of all the magnetic paths shown in FIG. 1–FIG. 9, different permanent magnets, different frame and brackets, annular and cylindrical magnetic body of different section shapes and different connecting circuits of the coils of converter can form different kinds of mechanic-electrical converters. All of these modifications are included in the invention.

Industrial Application

The main advantages of the mechanic-electrical converter of the invention are as follows:

1. No adhesive is used between the upper and lower yokes as well as the pole faces of the permanent magnet. Thus the assembly technology has been simplified, the magnetic resistance is reduced and the problem of disconnection and "chucking" of coils caused by vortex heating is avoided.

2. High faithness. The electric audio converter with resistance load characteristic can be realized which is capable of significant increase the output voice level at the low frequency and high-frequency end of the converter, eliminating the phase distortion of the converter and decreasing the distortion of resonance wave.

3. High sensitivity. In the condition of the same diameter and material and technological level, the efficiency of the converter is increased by 2–16 times with comparison of the traditional ones.

4. It is possible to manufacture converter with long or extreme long strokes.

5. Small volume, simple construction and high ratio of performance to price, easy to mass production.

What is claimed is:

1. A converter with two coils and two magnetic gaps comprising the magnetic path of permanent magnet and the frame integral with it, two coaxial annular magnetic gaps of the same diameters and a bobbin inserted into the magnetic gap on which the insulated wiring is parallelly wound to form two coils is characterized in that:

a) The upper and lower yokes of the said magnetic path are two coaxial and symmetric innerwardly concave plates made of magnetic material on the outer central portion of which a boss face is provided with a shaft hole which usually is a round hole, but can be a square or hexagonal hole;

b) The convex peripheral pole shoes are formed on the inner peripheries of the said upper and lower yokes, and a piece or more of the permanent magnets uniformly spaced with equal thickness and axial magnetization is provided between the pole faces of two peripheral pole shoes;

c) A hollow frame of non-magnetic material is embedded and bound to the inner face of the concave plates of the said upper and lower yokes with the inner vertical face of the permanent magnet mounted and bounded to the inner vertical face of the hollow frame;

d) Two pole faces of the said permanent magnet are engaged with the upper yoke and two pole faces of the peripheral pole shoes of the lower yoke; and a outer core of an integral magnetic path is formed by means of the through holes formed on the said boss faces of the upper and lower yokes, associated threaded holes, and the static pressure applied to the engaging pole faces by non-magnetic fasteners;

e) Two coaxial annular magnetic gaps of the same diameter are formed between the outer peripheric of the annular or cylindrical magnetic body coaxial with the central hole of the inner concave plates of the upper and lower yokes and the vertical peripheric of the central holes of the upper and lower yokes, also two coaxial coils are inserted into the said annular magnetic gap, while wound direction of two coils and the direction of current produce an electrodynamic force Fin the coils in the same moment and same direction;

f) With the dividing bisectrix x—x of half the axial highness of the said permanent magnet as the horizontal symmetric axis the said converter with two coils and two magnetic gaps has the symmetric magnetic path in geometry and magnetic characteristics, also the two coils have opposite wound directions after connecting in series while the section area of the wiring of the two coils, their turns and absolute value of the inductance are equal to each other with the said converter being a mechanic-electrical converter with resistance load characteristics.

g) The said coils and the central hole of the said inner concave plate are matched with the said annular or cylindrical magnetic body, with its optimum section being hexagonal and a short symmetric are provided on the top of inner corners of the hexagon or regular polygon while the arc is tangential to both sides of the inner corner and its center is located on the dividing line of the inner corner;

h) More than two uniformly spaced inner concave convection holes are provided on the peripheric pole shoes of the upper and lower yokes with the deepest bottom leveled with the inner face of the said inner concave plate;

i) Adhesive between the upper and lower yokes as well as the permanent magnet and the said hollow frame is cured after the outer core of the magnetic path has been assembled.

2. The converter with two coils and two magnetic gaps according to claim 1 is characterized in that the said upper and lower yokes are two round inner concave plates, and the said permanent magnet is an annular permanent magnet or more than a piece of uniformly spaced sectorial or circular or annular rare metal permanent magnet.

3. The converter with two coils and two magnetic gaps according to claim 1 is characterized in that the said upper and lower yokes are two inner concave plates with multisides and the permanent magnet is 3 or more than 3 pieces of uniformly spaced strip-like rare-metal permanent magnet with the same thickness.

4. The converter with two coils and two magnetic gaps according to claim 1 is characterized in that the said upper and lower yokes are two rectangular inner concave plates and the permanent magnet is 4 pieces of uniformly spaced Strip-like rare-metal permanent magnets of the same thickness.

5. The converter with two coils and two magnetic gaps according to claim 1 is characterized in that the upper and lower yokes and the vertical outer periphery of the permanent magnet are closed by two or more than two collars of driver made of non-magnetic material, the inner face of the collar and the yokes as well as the vertical outer face of the permanent magnet are engaged as an integral magnetic path; a bracket made of non-magnetic material with a hole in the central portion; and with the central axis as of the hole as symmetric axis, an inner convex boss face is formed on the outer side of the hole with an coaxial annular concave groove on the outer side of the said boss face; also a coaxial mounting face of the bracket engaged with the outer boss face of the lower yoke is provided on the outer side of the said annular concave groove, and coaxial annular or cylindrical magnetic body is mounted on the axial position of the said boss face by a set of non-magnetic fasteners, two coaxial annular magnetic gaps of the same diameters are formed between the outer periphery of the annular cylindrical magnetic body and the vertical periphery of the central hole of the upper and lower yokes, thus forming a complete magnetic path of the driver of the converter with two coils and two magnetic gaps.

6. The converter with two coils and two magnetic gaps according to claim 1 is characterized in that a coaxial frame is connected with the said magnetic path with a coaxial open cylinder provided on the waist of the frame, coaxial annular concave groove is formed on the inner face of the bottom of the said cylinder with two coaxial annular boss faces provided on the inner and outer sides of the said annular groove, an inner convex cylinder of non-magnetic material is provided on the axial position of the middle annular boss face to fix the annular magnetic body on the said cylinder; a non-magnetic annular connecting plate closes the vertical faces of the upper and lower yokes, to embed the integral core of said magnetic path to the inner fitting face of the frame cylinder forming a integral unit with the frame.

7. A converter with two coils and two magnetic gaps comprising a magnetic path of permanent magnet and a frame integral with it, two coaxial annular magnetic gaps of the same diameters and a coil bobbin inserted in the magnetic gap on which the insulated wiring is parallelly wound to form two coils is characterized in that:

a) The upper and lower yokes of the said magnetic path are two coaxial and symmetric innerwardly concave plates made of magnetic material on the outer central portion of which a boss face is provided with a shaft hole which usually is a round hole, but can be a square or hexagonal hole;

b) The convex peripheral pole shoes are formed on the inner peripheries of the said upper and lower yokes, and a piece or more of the permanent magnets uniformly spaced with equal thickness and axial magnetization is provided between the pole faces of two peripheral pole shoes;

c) A hollow frame of non-magnetic material is embedded and bound to the inner face of the concave plates of the said upper and lower yokes with the inner vertical face of the permanent magnet mounted and bounded to the inner vertical face of the hollow frame;

d) Two pole faces of the said permanent magnet are engaged with the upper yoke and two pole faces of the peripheral pole shoes of the lower yoke; and a outer core of an integral magnetic path is formed by means of the through holes formed on the said boss faces of the upper and lower yokes, associated threaded holes, and the static pressure applied to the engaging pole faces by non-magnetic fasteners;

e) Two coaxial annular magnetic gaps of the same diameter are formed between the outer peripheric of the annular or cylindrical magnetic body coaxial with the central hole of the inner concave plates of the upper and lower yokes and the vertical peripheric of the central holes of the upper and lower yokes, also two coaxial coils are inserted into the said annular magnetic gap, while wound direction of two coils and the direction of current produce an electrodynamic force Fin the coils in the same moment and same direction;

f) The said coils and the central hole of the said inner concave plate are matched with the said annular or cylindrical magnetic body, with its optimum section being hexagonal and a short symmetric are provided on the top of inner corners of the hexagon or regular polygon while the arc is tangential to both sides of the inner corner and its center is located on the dividing line of the inner corner;

g) More than two uniformly spaced inner concave convection holes are provided on the peripheric pole shoes of the upper and lower yokes with the deepest bottom leveled with the inner face of the said inner concave plate;

h) Adhesive between the upper and lower yokes as well as the permanent magnet and the said hollow frame is cured after the outer core of the magnetic path has been assembled.

8. The converter with two coils and two magnetic gaps according to claim 7 is characterized in that the said upper and lower yokes are two round inner concave plates, and the said permanent magnet is an annular permanent magnet or more than a piece of uniformly spaced sectorial or circular or annular rare metal permanent magnet.

9. The converter with two coils and two magnetic gaps according to claim 7 is characterized in that the said upper and lower yokes are two inner concave plates with multi-sides and the permanent magnet is 3 or more than 3 pieces of uniformly spaced strip-like rare-metal permanent magnet with the same thickness.

10. The converter with two coils and two magnetic gaps according to claim 7 is characterized in that the said upper and lower yokes are two rectangular inner concave plates and the permanent magnet is 4 pieces of uniformly spaced Strip-like rare-metal permanent magnets of the same thickness.

11. The converter with two coils and two magnetic gaps according to claim 7 is characterized in that the upper and lower yokes and the vertical outer periphery of the permanent magnet are closed by two or more than two collars of driver made of non-magnetic material, the inner face of the collar and the yokes as well as the vertical outer face of the permanent magnet are engaged as an integral magnetic path; a bracket made of non-magnetic material with a hole in the central portion; and with the central axis as of the hole as symmetric axis, an inner convex boss face is formed on the outer side of the hole with an coaxial annular concave groove on the outer side of the said boss face; also a coaxial mounting face of the bracket engaged with the outer boss face of the lower yoke is provided on the outer side of the said annular concave groove, and coaxial annular or cylindrical magnetic body is mounted on the axial position of the said boss face by a set of non-magnetic fasteners, two coaxial annular magnetic gaps of the same diameters are formed between the outer periphery of the annular cylindrical magnetic body and the vertical periphery of the central hole of the upper and lower yokes, thus forming a complete magnetic path of the driver of the converter with two coils and two magnetic gaps.

12. The converter with two coils and two magnetic gaps according to claim 7 is characterized in that a coaxial frame is connected with the said magnetic path with a coaxial open cylinder provided on the waist of the frame, coaxial annular concave groove is formed on the inner face of the bottom of the said cylinder with two coaxial annular boss faces provided on the inner and outer sides of the said annular groove, an inner convex cylinder of non-magnetic material is provided on the axial position of the middle annular boss face to fix the annular magnetic body on the said cylinder; a non-magnetic annular connecting plate closes the vertical faces of the upper and lower yokes, to embed the integral core of said magnetic path to the inner fitting face of the frame cylinder forming a integral unit with the frame.

13. A converter with two coils and two magnetic gaps comprising a magnetic path of permanent magnet and a frame integral with it, two coaxial annular magnetic gaps of the same diameters and a coil bobbin inserted in the magnetic gap on which the insulated wiring is parallelly wound to form two coils is characterized in that:

a) The upper and lower yokes of the said magnetic path are two coaxial and symmetric round plates made of magnetic material on the outer central portion of which a shaft hole, which usually is a round hole, but can be a square or hexagonal hole is provided;

b) Three or more sets of uniformly spaced permanent magnets of the same thickness are provided on the outer peripheric of the central hole of the said upper and lower yokes, each set of which is formed by 2 annular permanent magnets laminated in series and magnetized axially, and 4 pole faces of each set of permanent are directly engaged with two inner pole faces of the upper and lower yokes, the upper and lower yokes are connected by the static force applied to the engaged faces of each set of permanent magnets caused by the non-magnetic fasteners and also by the through holes formed on the axial portion of each set of annular permanent magnets on the upper and lower yokes, as well as threaded holes thus forming a outer core of integral magnetic path;

c) Two coaxial annular magnetic gaps of the same diameter are formed between the outer peripheric of the annular or cylindrical magnetic body coaxial with the central hole of the upper and lower yokes and the vertical peripheric of the central holes of the upper and lower yokes, also two coaxial coils are inserted into the said annular magnetic gap, while wound direction of two coils and the direction of current produce an electrodynamic force Fin the coils in the same moment and same direction;

d) With the dividing bisectrix x—x of half the axial highness of the said permanent magnet as the horizontal symmetric axis the said converter with two coils and two magnetic gaps has the symmetric magnetic path in geometry and magnetic characteristics, also the two coils have opposite wound directions after connecting in series while the section area of the wiring of the two coils, their turns and absolute value of the inductance are equal to each other with the said converter being a mechanic-electrical converter with resistance load characteristics.

e) The said coils and the central hole of the said round plate are matched with the said annular or cylindrical magnetic body, with its optimum section being hexagonal and a short symmetric are provided on the top of inner corners of the hexagon or regular polygon while the arc is tangential to both sides of the inner corner and its center is located on the dividing line of the inner corner;

f) Clearance is provided between the outer faces of uniformly spaced each set of permanent magnets, thus forming the convection ventilation path of the driver of the converter with two coils and two magnetic gaps.

14. The converter with two coils and two magnetic gaps according to claim 13 is characterized in that a non-magnetic rigid bracket is provided with a shaft hole in the central portion, a coaxial inner convex boss face is formed on the outer side of the shaft hole, and a coaxial annular concave groove is formed on the outer side of the inner convex boss face also a mounting face of the bracket engaged with the outer boss face of lower yoke is provided on the outer side of the annular concave groove, a coaxial annular or cylindrical magnetic body is secured to the axial position of the inner convex boss face by a set of non-magnetic fasteners, and two coaxial annular magnetic gaps of the same diameters are formed between the outer peripheric of the annular or cylindrical magnetic body and the vertical periphery of the central hole of the upper and lower yokes, thus forming a complete magnetic path of the driver of the converter with two coils and two magnetic gaps.

15. The converter with two coils and two magnetic gaps according to claim 13 is characterized in that a coaxial frame is connected with the said magnetic path with a coaxial open cylinder provided on the waist of the frame, coaxial annular concave groove is formed on the inner face of the bottom of the said cylinder with two coaxial annular boss faces provided on the inner and outer sides of the said annular groove, an inner convex cylinder of non-magnetic material is provided on the axial position of the middle annular boss face to fix the annular magnetic body on the said cylinder, and to embed the integral core of said magnetic path to the inner fitting face of the frame cylinder forming a integral unit with the frame.

16. A converter with two coils and two magnetic gaps comprising a magnetic path of permanent magnet and a frame integral with it, two coaxial annular magnetic gaps of the same diameters and a coil bobbin inserted in the magnetic gap on which the insulated wiring is parallelly wound to form two coils is characterized in that:

a) The upper and lower yokes of the said magnetic path are two coaxial and symmetric round plates made of magnetic material on the outer central portion of which a shaft hole, which usually is a round hole, but can be a square or hexagonal hole is provided;

b) Three or more sets of uniformly spaced permanent magnets of the same thickness are provided on the outer peripheric of the central hole of the said upper and lower yokes, each set of which is formed by 2 annular permanent magnets laminated in series and magnetized axially, and 4 pole faces of each set of permanent are directly engaged with two inner pole faces of the upper and lower yokes, the upper and lower yokes are connected by the static force applied to the engaged faces of each set of permanent magnets caused by the non-magnetic fasteners and also by the through holes formed on the axial portion of each set of annular permanent magnets on the upper and lower yokes, as well as threaded holes thus forming a outer core of integral magnetic path;

c) Two coaxial annular magnetic gaps of the same diameter are formed between the outer peripheric of the annular or cylindrical magnetic body coaxial with the central hole of the upper and lower yokes and the vertical peripheric of the central holes of the upper and lower yokes, also two coaxial coils are inserted into the said annular magnetic gap, while wound direction of two coils and the direction of current produce an electrodynamic force Fin the coils in the same moment and same direction;

d) The said coils and the central hole of the said round plate are matched with the said annular or cylindrical magnetic body, with its optimum section being hexagonal and a short symmetric are provided on the top of inner corners of the hexagon or regular polygon while the arc is tangential to both sides of the inner corner and its center is located on the dividing line of the inner corner;

e) Clearance is provided between the outer faces of uniformly spaced each set of permanent magnets, thus forming the convection ventilation path of the driver of the converter with two coils and two magnetic gaps.

17. The converter with two coils and two magnetic gaps according to claim 16 is characterized in that a non-magnetic rigid bracket is provided with a shaft hole in the central portion, a coaxial inner convex boss face is formed on the outer side of the shaft hole, and a coaxial annular concave groove is formed on the outer side of the inner convex boss face also a mounting face of the bracket engaged with the outer boss face of lower yoke is provided on the outer side of the annular concave groove, a coaxial annular or cylindrical magnetic body is secured to the axial position of the inner convex boss face by a set of non-magnetic fasteners, and two coaxial annular magnetic gaps of the same diameters are formed between the outer peripheric of the annular or cylindrical magnetic body and the vertical periphery of the central hole of the upper and lower yokes, thus forming a complete magnetic path of the driver of the converter with two coils and two magnetic gaps.

18. The converter with two coils and two magnetic gaps according to claim 16 is characterized in that a coaxial frame is connected with the said magnetic path with a coaxial open cylinder provided on the waist of the frame, coaxial annular concave groove is formed on the inner face of the bottom of the said cylinder with two coaxial annular boss faces provided on the inner and outer sides of the said annular groove, an inner convex cylinder of non-magnetic material is provided on the axial position of the middle annular boss face to fix the annular magnetic body on the said cylinder, and to embed the integral core of said magnetic path to the inner fitting face of the frame cylinder forming a integral unit with the frame.

* * * * *